United States Patent [19]

Forrest

[11] 3,998,597

[45] Dec. 21, 1976

[54] APPARATUS FOR MANUFACTURE OF SENSITIZED FINE PARTICLE PENETAERYTHRITOL TETRANITRATE

[75] Inventor: Charles D. Forrest, Hollister, Calif.

[73] Assignee: Teledyne McCormick Selph, Hollister, Calif.

[22] Filed: Feb. 25, 1974

[21] Appl. No.: 445,692

Related U.S. Application Data

[62] Division of Ser. No. 434,753, Jan. 18, 1974.

[52] U.S. Cl. ..... 23/266; 23/260; 23/273 R; 260/644; 260/645; 259/4 R; 149/93

[51] Int. Cl.[2] ..... C06B 21/00

[58] Field of Search ..... 23/266, 285, 260, 273 R, 23/295; 260/688, 644–646; 149/93

[56] References Cited

UNITED STATES PATENTS

| | | | |
|---|---|---|---|
| 449,687 | 4/1891 | Maxim | 23/266 X |
| 2,363,834 | 11/1944 | Crater | 23/266 |
| 2,881,057 | 4/1959 | Cole | 23/266 X |
| 3,351,585 | 11/1967 | Lee et al. | 260/645 X |
| 3,468,322 | 9/1969 | Katzer | 23/271 R X |
| 3,754,061 | 8/1973 | Foresest et al. | 149/93 X |

*Primary Examiner*—James H. Tayman, Jr.
*Attorney, Agent, or Firm*—David H. Semmes

[57] ABSTRACT

An apparatus to allow manufacture of fine particle PETN (penetaerythritol tetranitrate) having a sensitivity to propagate in thin layers in slurry and having a particle size which presents advantages in safety of handling and ability to obtain higher solids loading in slurries and flexible explosive binder systems due to a lower surface area, and a wider particle size distribution, compared to previous PETN of similar sensitivity to propagation in thin layers, i.e., as the major explosive ingredient in flexible sheet explosive formulations, and to propagation as a high velocity detonation in small core loads, i.e., 1 grain/ft., in mild detonating fuse, confined detonating fuse, and the like.

6 Claims, 1 Drawing Figure

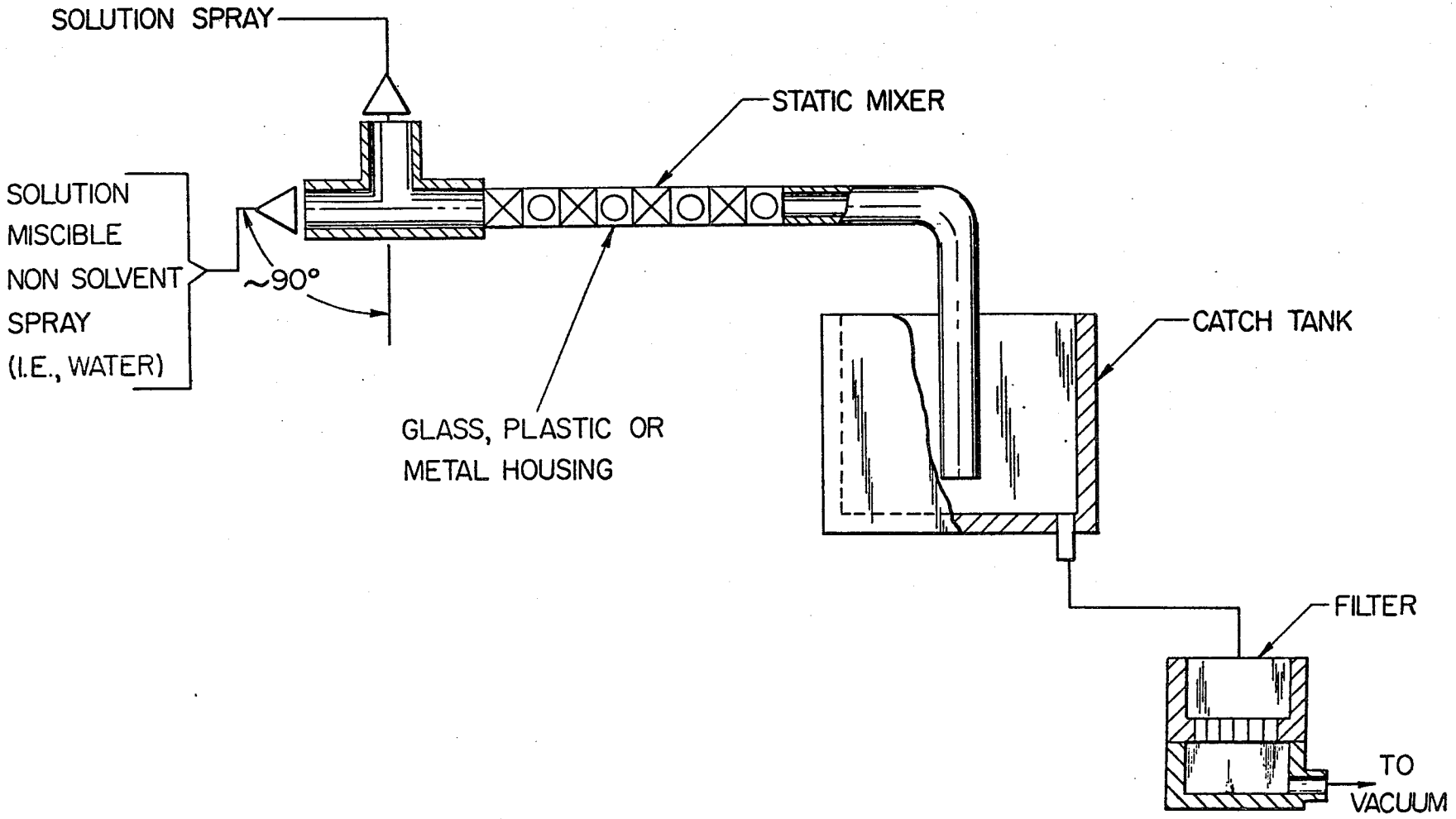
SOLUTION SPRAY
STATIC MIXER
CATCH TANK
FILTER
TO VACUUM
GLASS, PLASTIC OR METAL HOUSING
~90°
SOLUTION MISCIBLE NON SOLVENT SPRAY (I.E., WATER)

APPARATUS FOR MANUFACTURE OF SENSITIZED FINE PARTICLE PENETAERYTHRITOL TETRANITRATE

This is a division of application Ser. No. 434,753, filed Jan. 18, 1974.

BACKGROUND OF THE INVENTION

Fine particle PETN having sufficient sensitivity to propagate in thin layers in slurry form has been produced as "super-fine PETN" as shown in, for example, Canadian Pat. No. 705,348. The particle size of this previously known product has inherent drawbacks as regards safety of handling due to a tendancy to form dust which can collect in crevices and cracks, where similar surface electrical charge on particles tends to disperse super-fine particles, and the super-fine particles decrease ability to obtain high solids loading in slurries and flexible explosive binder systems.

The present invention discloses apparatus for practicing a method of producing fine particle PETN which significantly overcomes these drawbacks and inherent disadvantages heretofore existent.

BRIEF DESCRIPTION OF THE INVENTION

The present invention teaches an apparatus for manufacture of sensitized fine particle penetaerythritol tetranitrate (PETN), the sensitivity being defined as the ability of the PETN, disclosed herein, to propagate a stable high order detonation in thin layers or small cross-sectional areas as compared to ordinary forms of crystalline PETN.

Additional objects, advantages and features of the invention will be more readily apparent from the following detailed description of an embodiment thereof when taken together with the accompanying drawing in which:

FIG. 1 is a schematic view of apparatus for practicing the present invention.

In practice the sensitized fine particle PETN, in which "sensitivity" is defined as the ability of the PETN, disclosed herein, to propagate a stable high order detonation in thin layers or small cross-sectional area, compared to ordinary forms of crystalline PETN, is produced by a series of steps utilizing the apparatus as disclosed. Ordinarily, the propagation sensitivity considered is measured in practice on a physical mixture of PETN and a binder to form either an explosive slurry, or an elastomeric bonded sheet, cord, tube, or other form.

The precipitation operation employed to produce sensitive fine particle PETN is as follows:

1. Dissolve PETN in solvent such as acetone or methyl ethyl ketone (filtration is optional).
2. Begin a miscible non-solvent spray and continue until bottom of catch tank is covered to act as a safety cushion.
3. Begin solution spray and continue until all solution has been sprayed into miscible non-solvent spray.
4. Pass mixed stream of solution and non-solvent through static mixer element (optional, to reduce non-solvent to solvent ratio).
5. Collect product in catch tank under inert gas blanket, for safety.
6. Filter (vacuum filter preferred, although gravity or other filter may be used if properly designed for safety of operation -- vacuum filter aids in removal of solvent fumes).

In order to render the PETN particles sensitive to propagation in thin layers or small cross-sectional area it is necessary to dry the PETN until it is substantially free of liquids. Drying may be accomplished in any safe manner.

The sensitivity of the fine particle PETN is believed to be developed during the precipitation process with the present apparatus as follows:

Once the PETN is fully dissolved it loses its original crystalline identity and becomes like any other PETN solution except for differences due to chemical impurities and the like. By impinging relatively fine subdivided spray patterns of PETN solution with miscible non-solvent, such as water, in a certain minimum ratio of non-solvent solution, the PETN in solution is caused to nucleate and precipitate essentially immediately. While the entire mechanism is not completely understood, it is believed the ultimate particle size distribution is related to the droplet sizes and their kinetic energy and relative interaction upon impact of non-solvent spray with droplets of solution spray. Obviously, all such possible combinations are not possible or even desirable to list, since such a compilation would be virtually endless. Rather, herein is given an approximate "envelope" defined by (1) ratio of non-solvent to solution, and (2) solution concentration, and further modified by some temperature considerations. These numerous tiny crystallites being precipitated essentially simultaneously in close proximity to one another, join at first loosely together to form large irregular shaped particle of PETN. Passage of these large, somewhat irregular particles of PETN through a length of PIPE or other constrainment which may contain a static mixer element, such as a Kenics Static Mixer, and which at the same time contains and is further co-mixed with a minimum required amount of non-solvent to effect essentially complete precipitation, causes the irregular particles to become somewhat more regular in shape by an erosion process, and for the crystallites to become permanently bonded together upon further removal of solvent as a result of dilution by the miscible non-solvent.

Due to the rapidity with which the crystallites are joined together after first being precipitated as separate entities from solution, the larger PETN particles composed of these crystallites contain numerous voids or crystal irregularities associated with particles interstices, and the like.

Upon eventual drying of the PETN, it is believed the original liquid in these voids is ultimately replaced by a gas phase, possibly air, by a process of diffusion. It is further believed that as the liquid exits the PETN particles probably as a vapor, that it in some way seals the exit passages to re-entry by liquids, but this does permit entry of gas or air into at least a significant portion of the number of original voids. It is further believed that in subsequent detonation reactions which involve the sensitized PETN, that the passage of a shock wave through each PETN particle so sensitized compresses the gas in these void spaces, and does so essentially *adiabatically*. The net result is a tremendous increase in temperature and energy at each of the void sites which with the speed allowed by physical law, pumps heat energy into the detonation reaction zone. This increased energy, in turn, serves to shorten the length of the reaction zone adjacent to the Chapman-Jouget detonation plane, and thus reduces high order detonation.

While the foregoing description infers a theory which results in the end product, the advantageous apparatus as claimed for the described method and resultant product is not to be limited in theory.

In practicing this method with this apparatus additional refinements have been found to be useful. The solvent, for example, can consist of methyl ethyl ketone in addition to the acetone as previously recited.

Through ratio control of the two flows into the chamber, PETN solution and miscible non-solvent are intermingled as sprays in a ratio not greater than about 1 to 3 by volume and preferably not greater than about 1 to 5 by volume. As schematically illustrated, well known valving is useful for this purpose. The miscible non-solvent can consist of water.

It has also been found that the solution and miscible non-solvent sprays should be impinged upon each other at an angle of about 10° to about 120° and preferably, an angle of about 90° for the two inlets into the chamber is advantageous as shown in the drawing. As further illustrated, the spray impinging apparatus comprises two inlet chambers, each uniform diameter right circular cylinders, with one end opening into the main mixing chamber area. The other end of each inlet chamber accepts the described sprays, as formed by any conventional nozzle means.

According to the choice of nozzle inlets the average spray droplet size expressed in mean diameter is between about 1 micron and about 200 microns. Additionally, the PETN solution concentration preferably lies between about 30% to about 95% of the saturation point at solution temperature.

Manifestly minor changes in details as shown and described hereinabove, can be effected without departing from the spirit and scope of the invention as defined in and limited solely by the appended claims.

I claim:

1. Apparatus operable for making sensitized fine particle penetaerythritol tetranitrate (PETN) comprising:

A. first mixing means operable for dissolving PETN in solvent to form a solution at a temperature not exceeding the solvent boiling point said first means including an outlet for said solution;

B. second means operable for intermingling the PETN solution with a miscible non-solvent in the form of fine sprays said second means comprising a main chamber, a first inlet chamber in flow connection with a source of a miscible non-solvent, wherein said first and second inlet chambers are uniform diameter right circular cylinders that, at one end, open into said main chamber to define an included angle, between the centerlines of said inlet chambers, of substantially 90° and each inlet chamber further includes, at its other end, nozzle means operable to form sprays, wherein the average spray droplet size expressed in mean diameter is between about 1 micron and about 200 microns, whereby said PETN solution and said non-solvent are formed as respective sprays within said first and second inlet chambers and thereafter directed to impinge on each other within said main chamber to therein form a mixed stream;

C. third means in flow connection with the mixed stream efflux from said chamber operable for collecting and filtering precipitated PETN to remove free liquid; and D. said third means including further means operable for drying the PETN particles until substantially free of included liquid, including inter-particle liquid.

2. Apparatus according to claim 1 wherein said first chamber inlet for PETN solution and said second chamber inlet for miscible non-solvent include ratio control means to intermingle said sprays in a ratio not greater than about 1 to 3 by volume and preferably not greater than about 1 to 5 by volume.

3. Apparatus according to claim 1, further including a static mixer in flow connection between said second and third means through which said mixed stream of intermingled PETN solution and miscible non-solvent is passed.

4. Apparatus according to claim 2, further including a static mixer in flow connection between said second and third means though which said mixed stream of intermingled PETN solution and mixcible non-solvent is passed.

5. Apparatus according to claim 1, wherein said third means includes in combination an intermediate catch tank wherein said mixed stream efflux is collected, and further means within said catch tank for providing an inert gas blanket, under which the mixed stream efflux is collected, and filtration means in flow connection with said collected efflux.

6. Apparatus according to claim 1, wherein said filtration means includes means to create a vacuum suction to aid in removal of solvent fumes.

* * * * *